US010142741B2

(12) United States Patent
Aubreville et al.

(10) Patent No.: US 10,142,741 B2
(45) Date of Patent: Nov. 27, 2018

(54) METHOD FOR REDUCING THE LATENCY PERIOD OF A FILTER BANK FOR FILTERING AN AUDIO SIGNAL, AND METHOD FOR LOW-LATENCY OPERATION OF A HEARING SYSTEM

(71) Applicant: SIVANTOS PTE. LTD., Singapore (SG)

(72) Inventors: Marc Aubreville, Nuremberg (DE); Oliver Dressler, Fuerth (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/409,701

(22) Filed: Jan. 19, 2017

(65) Prior Publication Data

US 2017/0208397 A1 Jul. 20, 2017

(30) Foreign Application Priority Data

Jan. 19, 2016 (DE) ..... 10 2016 200 637

(51) Int. Cl.
*H04S 3/02* (2006.01)
*H04R 25/00* (2006.01)
(Continued)

(52) U.S. Cl.
CPC ..... *H04R 25/353* (2013.01); *H04R 5/04* (2013.01); *H04R 25/505* (2013.01); *H04R 25/552* (2013.01); *G10L 19/0017* (2013.01)

(58) Field of Classification Search
CPC ..... H04R 25/353; H04R 5/04; H04R 25/505; H04R 25/552; H04S 3/02; G10L 19/0017
(Continued)

(56) References Cited

U.S. PATENT DOCUMENTS 5,502,747 A 3/1996 McGrath
7,251,271 B1 7/2007 Eriksson
(Continued)

FOREIGN PATENT DOCUMENTS

DE 69332975 T2 5/2004
DE 102014204557 A1 9/2015
(Continued)

OTHER PUBLICATIONS

Ashutosh Pandey et al.: "Low-Delay Signal Processing for Digital Hearing Aids" IEEE Transactions on Audio, Speech and Language Processing, vol. 19, No. 4, May 1, 2011 (May 1, 2011), pp. 699-710, XP011351998.

*Primary Examiner* — Paul S Kim
*Assistant Examiner* — Ubachukwu Odunukwe
(74) *Attorney, Agent, or Firm* — Laurence A. Greenberg; Werner H. Stemer; Ralph E. Locher

(57) ABSTRACT

A method for reducing the latency period of a filter bank for filtering an audio signal. A large number of signal blocks in the time domain are formed from the audio signal, wherein for at least a plurality of the signal blocks in each instance a filter function is predetermined, at least one partial interval of the signal block is predetermined as a prediction period, signal components of the signal block in the at least one partial interval are estimated for the prediction period, and a predicted signal block is generated from the signal components estimated for the prediction period and from the signal components of the signal block outside the prediction period. The predicted signal block, filtered with the predetermined filter function, is transformed into the frequency domain to form a transformed signal block. Signal components of the transformed signal block are output for further processing.

11 Claims, 2 Drawing Sheets

(51) Int. Cl.
*H04R 5/04* (2006.01)
*G10L 19/00* (2013.01)

(58) Field of Classification Search
USPC ..... 381/23.1, 17; 704/205, 206, 233, 500
See application file for complete search history.

(56) References Cited

U.S. PATENT DOCUMENTS

| | | | | |
|---|---|---|---|---|
| 9,055,377 | B2 | 6/2015 | Kinsbergen et al. | |
| 9,584,907 | B2 | 2/2017 | Aubreville et al. | |
| 2014/0177888 | A1* | 6/2014 | Zhang | H04R 25/505 381/317 |
| 2015/0264478 | A1 | 9/2015 | Aubreville et al. | |
| 2016/0307576 | A1* | 10/2016 | Fuchs | G10L 19/0017 |
| 2017/0311093 | A1* | 10/2017 | Andersen | H04R 25/505 |

FOREIGN PATENT DOCUMENTS

| | | | |
|---|---|---|---|
| EP | 2919485 | A1 | 9/2015 |
| WO | 2007014795 | A2 | 2/2007 |
| WO | 2012066149 | A1 | 5/2012 |

* cited by examiner

METHOD FOR REDUCING THE LATENCY PERIOD OF A FILTER BANK FOR FILTERING AN AUDIO SIGNAL, AND METHOD FOR LOW-LATENCY OPERATION OF A HEARING SYSTEM

CROSS-REFERENCE TO RELATED APPLICATION

This application claims the priority, under 35 U.S.C. § 119, of German patent application DE 10 2016 200 637.1, filed Jan. 19, 2016; the prior application is herewith incorporated by reference in its entirety.

BACKGROUND OF THE INVENTION

Field of the Invention

The invention relates to a method for reducing the latency period of a filter bank for filtering an audio signal. A large number of signal blocks in the time domain are formed from the audio signal. For at least a plurality of the signal blocks in each instance a filter function is predetermined, the signal block, filtered with the predetermined filter function, is transformed into the frequency domain, and by this means a transformed signal block is formed. Signal components of the transformed signal block are output for further processing. The invention further relates to a method for low-latency operation of a hearing system, wherein a first audio signal is generated from an acoustic signal by a first input transducer, wherein the first audio signal is filtered in a signal-processing unit by means of a first filter bank. Signal components of the filtered first audio signal are subjected to further processing in the signal-processing unit and used for generating an output signal. An output acoustic signal is generated from the output signal by an output transducer.

In a hearing aid, an audio signal generated by a microphone is usually transformed from the time domain into the frequency domain after digitization—that is to say, after digitization the audio signal is firstly present in the form of time-resolved samples which—where appropriate, grouped into individual signal blocks (so-called frames)—are decomposed by a Fourier transformation—such as FFT, for example—into individual spectral signal components of the generated audio signal. This has the advantage that frequency-selective algorithms—such as interference-noise reduction, directional microphony or dynamic compression—can be applied. However, the aforementioned transformation has the disadvantage that an audio signal that has been reconverted into the time domain after appropriate frequency-selective editing exhibits a delay in relation to the input signal, which is typically of the order of magnitude of several milliseconds (ms). This delay, also called latency, is the longer the higher the resolution in the frequency domain is chosen to be.

Many people who are hard of hearing suffer, first and foremost, from a loss of the ability to hear at high frequencies—for instance, a noticeably attenuated perception starting from 5-10 kHz—whereas for low frequencies they barely display any difference in comparison with a normal hearing person. In these cases, high frequencies are on principle amplified considerably.

Moreover, in this connection an open matching of the hearing aid is also frequently chosen, in which the output acoustic signal from a loudspeaker of the hearing aid is conducted in the auditory canal to the tympanic membrane (ear drum) via an acoustic tube with screens or via an earphone with screens. Consequently a mixture consisting of a frequency-selectively damped direct sound of the environment as well as the output acoustic signal generated by the hearing aid arrives at the tympanic membrane itself. Depending on the loss of hearing and type of matching, which in turn influences, in frequency-dependent manner, the damping of the direct sound from the environment to the sense of hearing, differing mixing ratios are therefore present, depending on the frequency.

In the case of the superimposition of correlated signals with time offset—such as are present, in the case just described, at the tympanic membrane by virtue of the direct sound of the environment and the output acoustic signal of the hearing aid—comb-filter effects often arise. These effects generate characteristic amplitude minima (notches) with equal spacing over the frequency, at which an almost complete extinction of the signal component of corresponding frequency takes place. The greater the temporal spacing between the two superimposed signals, the smaller the spacing of these amplitude minima in the frequency domain. By virtue of this, the signal resulting from the superimposition is distorted, and a reedy tone arises. Precisely in the case of binaural audio-signal processing, which finds application in binaural hearing systems, the latency is particularly long, and therefore the susceptibility to comb-filter effects is particularly high.

In order to avoid these comb-filter effects as far as possible, it is accordingly sensible to reduce the total latency in the binaural hearing system. However, the described problems with comb-filter effects are not tied to a binaural hearing system but may also arise in a monaural hearing system with only one hearing aid, in which a direct sound of the environment and an output acoustic signal of a hearing aid arrive at the tympanic membrane of the user in superimposed manner with temporal offset.

The temporal offset in this case is caused, first and foremost, by the internal latency of the hearing system for signal processing and, in this connection in particular, in the filtering.

United States patent application publication US 2015/0264478 A1 and its counterpart German published patent application DE 10 2014 204 557 A1 (commonly assigned) describes how, in particular for application in a binaural hearing aid, a wind noise in an input signal is reduced on the basis of the typical frequency spectrum of the wind noise. For a latency period that is as short as possible, it is proposed in this case to split the input signal into two partial signals and to filter the partial signals in each instance with differing frequency resolution and, consequently, latency. In the more highly resolved signal branch, filter parameters are now ascertained which are applied to the partial signal filtered with shorter latency.

U.S. Pat. No. 5,502,747 (cf. DE 693 32 975 T2) a method for filtering an input signal by means of a desired pulse response is cited, in which the pulse response in the time domain is decomposed into individual segments which are transformed into the frequency domain, and coefficient blocks for the filtering of the individual frames, time-delayed in relation to one another, are formed from these segments in each instance in the frequency domain. The frames filtered in this way with the coefficient blocks are added up with their corresponding time-delay, and a signal in the time domain is generated therefrom by inverse transformation, from which individual signal components are discarded in predetermined manner in order to obtain the finished, filtered output signal.

U.S. Pat. No. 7,251,271 B1 cites a method for avoiding so-called aliasing effects in the course of a filtering of a discretized input signal with a discrete pulse response. These effects can arise in the course of the transformation of the individual frames of the input signal from the time domain into the frequency domain and in the course of the inverse transformation of the product of pulse response and frequency spectrum of the input signal into the time domain. For the purpose of avoiding the aliasing effects, individual frames are lengthened prior to the respective transformation by adding zeros, in order to correspond with the respective filter length.

SUMMARY OF THE INVENTION

It is accordingly an object of the invention to provide a method for reducing the latency of a filter bank which overcomes the above-mentioned and other disadvantages of the heretofore-known devices and methods of this general type and which provides for a method for a low-latency (as far as possible) spectral filtering of an audio signal, with spectral resolution that is as high as possible. A second object underlying the invention is to specify a method for the low-latency operation of a hearing system.

With the foregoing and other objects in view there is provided, in accordance with the invention, a method for reducing the latency period of a filter bank for filtering an audio signal, the method comprising:

receiving an audio signal and forming from the audio signal a multiplicity of signal blocks in a time domain; and for at least a plurality of the signal blocks in each instance:

providing a filter function;

providing at least one partial interval of the respective signal block as a prediction period;

estimating signal components of the respective signal block in the at least one partial interval for the prediction period, and generating a predicted signal block from the signal components estimated for the prediction period and from the signal components of the respective signal block outside the prediction period; and transforming the predicted signal block, filtered with the predetermined filter function, into a frequency domain, to thereby form a transformed signal block; and outputting signal components of the transformed signal block for further processing.

In other words, the first above-mentioned object is achieved by a method for reducing the latency period of a filter bank for filtering an audio signal, wherein a large number of signal blocks in the time domain are formed from the audio signal. In this connection the invention provides that for at least a plurality of the signal blocks in each instance a filter function is predetermined, at least one partial interval of the signal block is predetermined as a prediction period, signal components of the signal block in the at least one partial interval are estimated for the prediction period, and a predicted signal block is generated from the signal components estimated for the prediction period and from the signal components of the signal block outside the prediction period. Furthermore, the invention provides that the predicted signal block, filtered with the predetermined filter function, is transformed into the frequency domain, and by this means a transformed signal block is formed, and signal components of the transformed signal block are output for further processing.

With the above and other objects in view there is also provided, in accordance with the invention, a method for low-latency operation of a hearing system, the method comprising:

generating a first audio signal from an acoustic signal by a first input transducer;

immediately transmitting the first audio signal to a signal-processing unit and immediately filtering the first audio signal in the signal-processing unit by way of a first filter bank by performing the method as outlined first above;

subjecting the signal components of the filtered first audio signal to further processing in the signal-processing unit and using the further processed signal components for generating an output signal; and immediately generating an output acoustic signal from the output signal by an output transducer.

In other words, the above-mentioned second object is achieved by a method for low-latency operation of a hearing system, wherein a first audio signal is generated from an acoustic signal by a first input transducer, wherein the first audio signal is transmitted immediately to a signal-processing unit and filtered immediately in the signal-processing unit by means of a first filter bank in accordance with the previously described method for reducing the latency period of a filter bank for filtering an audio signal, wherein signal components of the filtered first audio signal are subjected to further processing in the signal-processing unit and used for generating an output signal, and wherein an output acoustic signal is generated immediately from the output signal by an output transducer. Advantageous and, in part, viewed in themselves, inventive configurations are presented in the dependent claims and in the following description.

A signal block (frame) in the time domain is preferably formed from the audio signal by the audio signal being transformed, by time discretization and amplitude discretization, into a large number of characteristic amplitude values (samples) assigned in each instance to consecutive points in time, and by a large number of consecutive samples being combined in each instance into a signal block. The further processing of the signal components of the transformed signal block includes, in particular, a frequency-band-dependent amplification, a frequency-band-dependent directional characteristic, a frequency-band-dependent noise suppression and also an inverse transformation of signal components, processed in frequency-band-dependent manner, into the time domain.

The estimating of the signal components for the prediction period of a respective signal block is preferably undertaken via a prediction algorithm, such as by means of a linear prediction filter, for example. In particular, an adaptive matching of time-correlated coefficients used for the purpose of estimation is also possible in such a manner that an estimation coefficient that as a coordinate in the signal block is to be assigned in each instance to a sample with a certain time-delay is corrected in a manner depending on the error between an estimated sample and a real sample acquired from the audio signal, the correction being renewed at periodic intervals. In particular, a signal component estimated for a signal block is also used for a signal block following later if the period corresponding to the signal component then also still falls within the prediction period of the signal block following later. The prediction period preferably includes the respectively first and/or the respectively last sample of a signal block. In particular, in a signal block the period lying outside the prediction period forms a coherent interval in each instance. In particular, the prediction period comprises the first n samples and/or the last m samples, n and m being natural numbers less than the number of samples in the respective signal block.

By an "input transducer" or an "output transducer" of the hearing system, any form of an acousto-electric or an electro-acoustic transducer is encompassed, for instance a microphone or a loudspeaker. By an "immediate transmission of the first audio signal to the signal-processing unit," it is to be understood that the transmission of the first audio signal takes place immediately after the generation thereof—that is to say, in particular, it takes place without a further time-delay going beyond a signal preprocessing—such as, for example, A/D conversion and/or data compression—such as would occur, for example, as a result of a long-term physical storage that is not based on the FIFO principle (first-in-first-out). In this case the transmission is undertaken, in particular, locally within a hearing aid, for instance on the signal path predetermined by the signal lines. But, in particular, the transmission is also undertaken in wireless manner, for instance from a first hearing aid of a binaural hearing system to a second hearing aid of the binaural hearing system.

By an "immediate filtering of the first audio signal in the signal-processing unit", it is to be understood, analogously, that the filter process for the audio signal takes place immediately after the reception thereof in the signal-processing unit—that is to say, in particular, without a further time-delay going beyond the direct signal transmission, such as would occur, for example, as a result of a long-term storage that is not based on the FIFO principle (first-in-first-out). In the same way, by an "immediate generation of the output acoustic signal from the output signal" it is to be understood that immediately after the generation of the output signal by the further processing the output signal is relayed to the output transducer for output—that is to say, in particular, without a further time-delay going beyond the direct signal transmission, for example as a result of a long-term storage.

In hearing systems a significant proportion of the latency falls to the filter banks that are employed for transforming the audio signals generated by the input transducers into the frequency domain (analysis filter banks), and also to the filter banks for the inverse transformation of the frequency-resolved audio signals subjected to further processing into the time domain (synthesis filter banks), the former usually having a larger proportion. Furthermore, in the case of a binaural hearing system the transmission of an audio signal from one hearing aid to the other for the generation of a binaural output signal is also associated with a certain delay. However, the latter can only be diminished with difficulty, in view of the restrictions in connection with the coding for the purpose of transmission. Consequently, for an operation of the hearing system that is as low-latency as possible, also in the case of a binaural hearing system it is advantageous to reduce the latency period for the frequency-band filtering of the audio signal—that is to say, strictly speaking, of the analysis filter for the transformation into the frequency domain.

In order to reduce the latency period of the analysis filter, it would now firstly be possible to choose the individual signal blocks that are drawn upon in each instance for a filter process to be shorter—that is to say, to process fewer samples in a signal block—since for the processing of a signal block firstly all the samples of the signal block that are needed should preferably always be present. However, since the diminution of the samples in a signal block signifies a diminution of the information about the signal components that is available overall in the signal block, without the implementation of corrective measures this also leads to a diminished frequency resolution in the transformed signal block. However, this is undesirable, since many algorithms for signal processing that find application in hearing systems require a particularly frequency-selective application for a satisfactory tonal character in the final result.

By virtue of the fact that the signal components for the prediction period of a signal block are now estimated for the purpose of filtering, instead of using the corresponding, real signal components generated from the audio signal, given a suitable choice of the prediction period the effective length of the signal block can be decreased without the frequency resolution of the filter bank being impaired thereby. The frequency resolution of the filter bank depends on the temporal information content of the signal blocks to be used for the filter process—that is to say, on the length thereof. By virtue of the fact that in a signal block for a period the signal components are now estimated, the latency of the filter bank can be diminished by the duration corresponding to the associated prediction period.

In this case, each two temporally consecutive signal blocks preferentially overlap partially. The definition of the temporal sequence is preferably undertaken in this case via a reference sample for the respective signal block, for example the first sample. The consequence of the described overlap is that the consecutive signal blocks in question have several, preferably consecutive, samples in common. On the one hand, this improves the temporal resolution in the frequency domain, since by this means a frequent updating of the frequency-band information is made possible; on the other hand, by this means the effort when estimating the signal components can also be diminished, since signal components already estimated are available for a following block without a renewed estimation process.

Expediently, in each instance signal components of the transformed signal block according to various frequency bands are output separately for further processing. For a relaying of such a type, the latency of the filter bank, reduced by the estimating of the signal components of the prediction periods, is particularly advantageous in the case of constant high frequency resolution.

In each instance the filter function preferably exhibits a smaller—on average—transmission amplitude within the prediction period than outside the prediction period. This is intended to mean that the value of the transmission amplitude of the filter function averaged over the entire prediction period is less than the value of the transmission amplitude of the filter function averaged over the remaining period of the signal block outside the prediction period. For it is to be assumed in this case that, in the course of an appropriate filtering into the frequency domain by means of the filter function, errors that may arise for the prediction period as a result of deviations of the estimation of the signal components from the real signal components are largely suppressed as a consequence of the smaller—on average—transmission amplitude of the filter function, and consequently do not enter appreciably into the transformed signal block.

In an advantageous configuration, the transmission amplitude of the filter function is constituted in each instance by a logarithmically concave function, wherein the prediction period omits the maximum of the transmission amplitude of the filter function. A logarithmically concave function is defined as a function, the logarithm of which in the domain of definition—which is given here by the individual samples of the respective signal block—is concave. A function of such a type may be given, for instance, by an approximation to a Gaussian bell-shaped curve over a finite, discretized domain of definition. The advantage of the logarithmically concave behavior of the transmission amplitude is that the latter exhibits at most two points of inflection in the domain of definition and consequently is not subject to any oscillations whatever. This results in an advantageous filter response, since consequently no signal components that are relevant in themselves are filtered with a minimum value of an oscillation of the filter function.

It proves to be particularly expedient if, in each instance, the prediction period contains only convex regions of the transmission amplitude of the filter function. A logarithmically concave function can be represented as a function that is reciprocal to a certain logarithmically convex function. A logarithmically convex function is, in turn, again convex. This means that the logarithmically concave function that is reciprocal thereto exhibits, as a consequence of the reciprocity property, at most two points of inflection.

Given a suitable choice of the filter function, for instance an approximation to a Gaussian bell-shaped curve, the maximum of the transmission amplitude lies within a convex region, so that beyond the points of inflection the transmission amplitude ends up concave. In these two regions the transmission amplitude ordinarily already exhibits sufficiently low values, so that with the choice of the prediction period within at least one of the two regions it can be ensured that errors that may arise by reason of the deviations of the estimate of the signal components from the real signal components are largely suppressed as a consequence of the sufficiently smaller transmission amplitude of the filter function, and consequently do not enter appreciably into the transformed signal block.

It proves to be advantageous, furthermore, if a blank signal is estimated in each instance as signal components for the prediction period of at least one signal block. A blank signal in this connection is that signal which has no amplitude whatever for the period in question. The estimating of a blank signal is undertaken, in particular, in the case where the signal components of the audio signal that are used for the method for estimating the signal components of the prediction period do not permit a sufficiently high-quality estimation of the signal components as a consequence of defective correlations. This may arise, for instance, if a high proportion of white noise is present in the audio signal, decreasing the correlation of consecutive samples and hence making a prediction difficult.

In particular, signal components, estimated by means of a prediction, that are different from the blank signal are to be compared with the corresponding real signal components of the audio signal as regards the quality of the estimate, in order to be able to assess the quality of the prediction. In the case of a deviation that is too great—defined via a measure of deviation such as, for example, a differential amount averaged over several samples and via an associated upper bound for the measure of deviation—a blank signal, instead of the predicted signal components, is established as signal component estimated for the prediction period. In the same way, it is possible to examine the signal components of the audio signal for correlations even prior to the prediction, and, in the case of a correlation that is too low, to establish a blank signal directly as signal component for the prediction period.

In a further advantageous configuration of the method for low-latency operation of a hearing system, a second audio signal is generated from the acoustic signal by a second input transducer spatially separated from the first input transducer, the second audio signal being transmitted immediately to the signal-processing unit and filtered by means of a second filter bank, and signal components of the filtered second audio signal being subjected to further processing in the signal-processing unit and used for generating the output signal.

In particular, the filtering of the second audio signal is undertaken by means of the second filter bank in accordance with the previously described method for reducing the latency period of a filter bank for filtering an audio signal. By an "immediate transmission of the second audio signal to the signal-processing unit", it is to be understood that the transmission of the second audio signal takes place without a further time-delay going beyond a signal preprocessing such as, for example, A/D conversion and/or data compression as well as the direct signal transmission, such as would occur, for example, as a result of a long-term physical storage that is not based on the FIFO principle (first-in-first-out).

This cited configuration enables, by virtue of the method, in particular a low-latency operation of a binaural hearing system, taking into consideration the peculiarities arising in such a hearing system as a consequence of the signal transmission taking place from one hearing aid to the other for the generation of the binaural sense of hearing. Since often in the case of a binaural hearing system for the purpose of compression the real information content of signal components of the audio signal that is received from the respective other hearing aid for the generation of the binaural sense of hearing is reduced for the purpose of better transmission, for instance by data compression, the possible error induced by the estimation of the signal components within the prediction period is reduced in its significance. In the case of this audio signal, a loss of information already takes place by virtue of the transmission, so that by virtue of the estimation for the prediction period the deviations do not represent an additional cumulative source of errors but represent only a source of errors to be regarded as an alternative. Expressed concisely, it matters little whether an error occurs statistically by virtue of the data compression or by virtue of the estimation.

A further advantage of the application of the method for low-latency operation of a binaural hearing system is that a certain latency of several ms is already introduced into the hearing system by the described transmission of the audio signals. The reduction of further possible latencies—such as, in the present case, by virtue of the filter banks, for example—helps here to keep the losses of tonal quality by virtue of comb-filter effects as slight as possible.

The invention cites, furthermore, a hearing aid comprising at least one input transducer for generating an audio signal, an output transducer for generating an output acoustic signal, and also a local signal-processing unit with a first filter bank, said hearing aid having been set up to implement the previously described method for reducing the latency period of a filter bank for filtering an audio signal. The advantages stated for the method and its further developments can in this connection be carried across analogously to the hearing aid.

The invention cites, in addition, a binaural hearing system with two previously described hearing aids, which has been set up to implement the method for low-latency operation of a hearing system with at least two input transducers. The advantages stated for the method and its further developments can in this connection be carried across analogously to the binaural hearing system.

Other features which are considered as characteristic for the invention are set forth in the appended claims.

Although the invention is illustrated and described herein as embodied in a method for reducing the latency period of a filter bank for filtering an audio signal, and method for low-latency operation of a hearing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Parts and quantities corresponding to one another have in each instance been provided in all the figures with identical reference symbols.

DETAILED DESCRIPTION OF THE INVENTION

Figure 1:
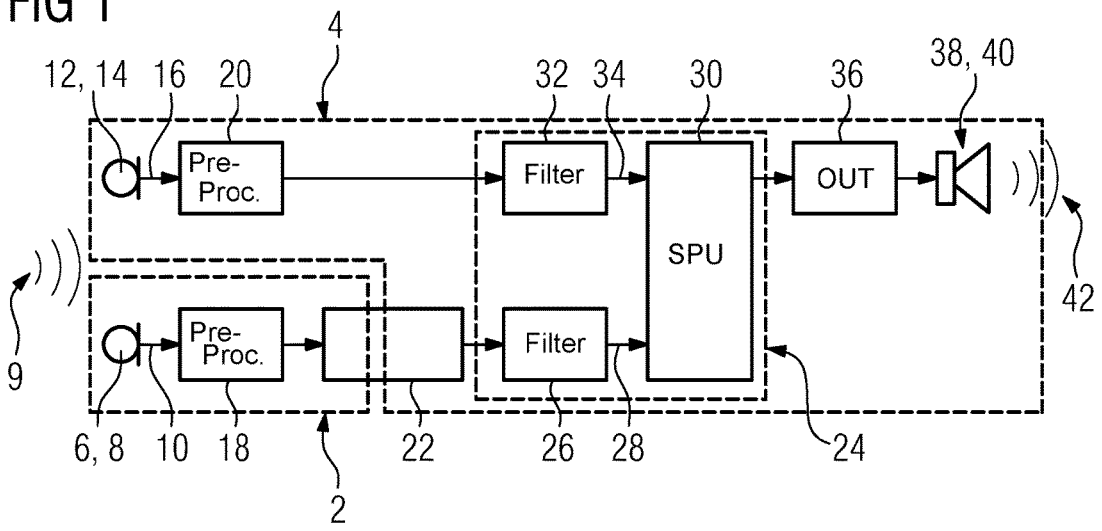
FIG. 1 is a block diagram of a binaural hearing system with two hearing aid devices.

Referring now to the figures of the drawing in detail and first, particularly, to FIG. 1 thereof, there is shown a binaural hearing system 1 represented schematically in a block diagram. The binaural hearing system 1 in this case is constituted by a first hearing aid 2 and a second hearing aid 4. The first hearing aid 2 has a first input transducer 8 configured as a microphone 6, which generates a first audio signal 10 from an acoustic signal 9. The second hearing aid 4 has a second input transducer 14 configured as a microphone 12, which generates a second audio signal 16 from the acoustic signal 9. The first audio signal 10 and the second audio signal 16 are prepared for the further signal-processing processes in the respective hearing aid 2, 4 by a local signal preprocessing 18, 20, respectively, which in each instance includes, in particular, an A/D conversion. The local signal preprocessing 18, 20 comprises in this case, in particular, only run-time processes, that is to say, those processes which involve no further delay beyond the duration of the signal processing itself taking place, in particular no longer-term operations for storage and loading of the signal components.

Immediately after the local signal preprocessing 18, the first audio signal 10 is firstly transmitted in a binaural transmission process 22 from the first hearing aid 2 to the second hearing aid 4, where it is filtered in a first filter bank 26 in a signal-processing unit 24 in a manner yet to be described. The binaural transmission process 22 is undertaken in this case immediately after the local signal preprocessing 18, that is to say, in particular, without further delay, in particular without longer-term operations for storage and renewed loading of the signal components in question beyond a FIFO memory. Frequency-band signal-processing algorithms 30, such as, for example, noise suppression, directional microphony or dynamic compression, are now applied to the filtered first audio signal 28. The signal processing is indicated in FIG. 1 by a signal processing unit SPU 30.

Immediately after the local signal preprocessing 20, the second audio signal 16 is supplied to the signal-processing unit 24, where it is firstly filtered in a second filter bank 32 in a manner yet to be described, the respective signal components in individual frequency bands being relayed separately as a filtered second audio signal 34. In the filtered second audio signal 34 resulting from the second filter bank 32 the respective signal components have been output separately in individual frequency bands. Frequency-band signal-processing algorithms 30, such as, for example, noise suppression, directional microphony or dynamic compression, are now also applied to the filtered second audio signal 34. From the filtered first audio signal 28 and the filtered second audio signal 34 an output signal 36 which locally mirrors the binaural sense of hearing at the location of the second hearing aid 4 is generated after the frequency-band signal processing in the SPU 30.

The output signal 36 is transformed immediately into an output acoustic signal 42, that is to say, in particular, without further longer-term operations for storage and renewed loading of the signal components, by an output transducer 40. Here, the output transducer is a loudspeaker 38.

Figure 2:
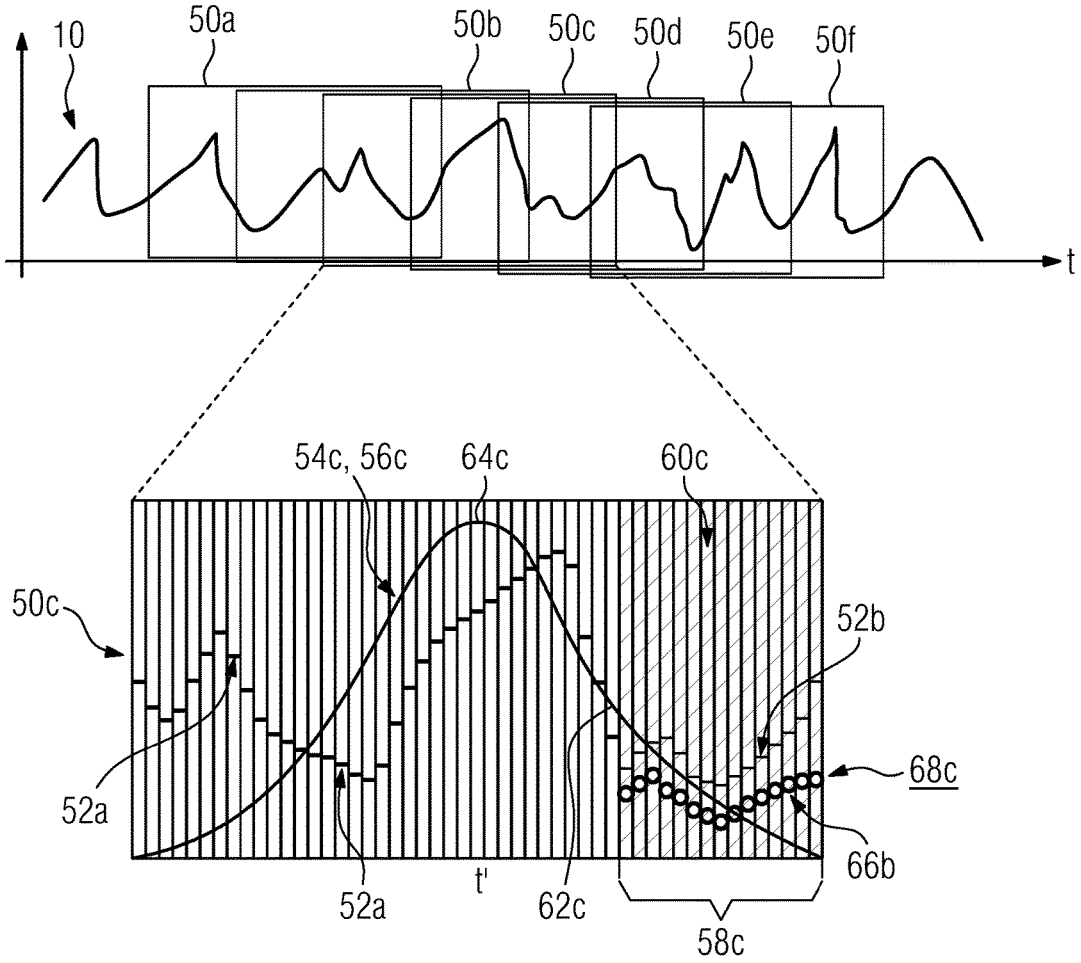
FIG. 2 is a time representation, of an audio signal generated by a hearing aid according to FIG. 1 and, in a detail representation, a signal block of the audio signal with a filter function and with a prediction period.

In FIG. 2 the first audio signal 10 according to FIG. 1 has been plotted against a time axis t, said signal being split into individual, partially overlapping signal blocks 50*a-f*. The individual signal blocks 50*a-f* are formed in this case from a large number of consecutive samples of the first audio signal 10, individual samples arising in each instance in at least two signal blocks as a consequence of the overlap of the consecutive signal blocks 50*a-f*. The individual signal blocks 50*a-f* are now transformed in each instance into the frequency domain in a manner yet to be described. By virtue of the short temporal spacing of each two consecutive signal blocks 50*a-f*, the spectral signal components of the first audio signal 10 can consequently be updated at brief time-intervals in the frequency domain. As a consequence of the relatively high number of individual samples, and consequently as a consequence of the high time-resolved information content per signal block 50*a-f*, in addition a high spectral resolution of the first audio signal 10 is also present after transformation into the frequency domain. In order to reduce the high latency arising at a high temporal resolution in the course of the filter process and the transformation into the frequency domain, certain signal components are estimated for the individual signal blocks 50*a-f*, this being shown for signal block 50*c* on the basis of a detail representation.

For signal block 50*c* the individual real signal components 52*a*, 52*b* have been shown against a time axis t'. The real signal components 52*a*, 52*b* in this case are given in each instance by the amplitude of the corresponding sample. Furthermore, for signal block 50*c* the transmission amplitude 54*c* of the filter function 56*c* has been shown, which in the present case is given, by approximation, by a Gaussian bell-shaped curve.

The filter function 56*c* in this case represents a window function with which the edges of signal block 50*c* are to be smoothed ("masked out") for the transformation into the frequency domain. This is undertaken, since without a window function of such a type the Fourier transformation of the signal components of signal block 50*c* is in fact a Fourier transformation of the signal components of the first audio signal 10 that are multiplied by a rectangular function corresponding to the duration of the signal block. As a consequence of the convolution theorem, this multiplication in the time domain signifies a convolution of the frequency components of the first audio signal 10 with the Fourier transform of the rectangular function, which is given by a strongly oscillating sin(x)/x function or sin c function. In order to avoid oscillations of such a type, the edges of signal block 50*c* are "masked out" by means of a suitable filter function 56*c* for the transformation into the frequency domain. This happens by the transmission amplitude 54*c* of the filter function 56*c* at the edges of signal block 50*c* converging to zero, as far as possible, in oscillation-free manner—that is to say, in particular, with as few points of inflection as possible. A function having properties of such a type is given, in particular, by a logarithmically concave function such as, for example, the approximated Gaussian bell-shaped curve of the present case.

The described progression of the transmission amplitude 54*c* of the filter function 56*c* can now be exploited for the purpose of diminishing the latency of the first filter bank 26 without thereby forfeiting resolving power in the frequency domain. For this purpose, a partial interval 58*c* at the temporal end of signal block 50*c* is defined as a prediction period 60*c*. The partial interval 58*c* lies beyond the point of inflection 62*c* of the transmission amplitude 54*c*, that is to say, in particular, far away from the maximum 64*c* of the transmission amplitude 54*c*, so that in the partial interval 58*c*, which defines the prediction period 60*c*, the transmission amplitude 54*c* only exhibits low values. For the prediction period 60*c*, instead of the real signal components 52*b* the signal components to be used for the transformation are now estimated there by means of a prediction algorithm, for example a linear prediction filter. The signal components 66*b* estimated within the prediction period 60*c* and the signal components 52*a* of signal block 50*c* outside the prediction period 60*c* now form a predicted signal block 68*c*.

This predicted signal block 68*c* is now multiplied by the filter function 56*c* and transformed into the frequency domain by way of a fast Fourier transformation, so that the frequency-resolved information of the transformed signal block 50*c* is available there for a further processing by means of frequency-band-dependent signal-processing algorithms. The described procedure for estimating signal components for a prediction period to be chosen favorably on the basis of the filter function to be used in each instance is also undertaken for the other signal blocks 50*a*, 50*b*, 50*d-f*, in order in this way to diminish the latency for the transformation into the frequency domain, since the respectively last samples of a signal block then do not need to be present at all, so the transformation can be begun several ms earlier as a consequence of the estimation.

An important role in this connection is played by the progression of the transmission amplitude 54*c* of the filter function 56*c*. A possible error that might result by virtue of the deviation of the signal components 66*b* estimated for the prediction period 60*c* from the real signal components 52*b* is suppressed by virtue of the fact that for the prediction period 60*c* the transmission amplitude 54*c* exhibits only comparatively low values relative to its maximum 64*c*, and consequently by virtue of the corresponding multiplication by the filter function 56*c* the estimated signal components 66*b* make, in any case, only a small contribution to the transformed signal block. However, this contribution is important for the spectral resolution. In particular, tonal signal components can in any case be estimated relatively well by means of conventional prediction methods. Even in the case of a white noise, which is to be estimated unfavorably as a consequence of its static properties, the described method provides good results as a consequence of the stated suppression of the errors by virtue of possible deviations.

In the binaural hearing system 1 of FIG. 1 the first audio signal 10 is filtered in the first filter bank 26 in accordance with the method described on the basis of FIG. 2. The filtering of the second audio signal 16 in the second filter bank 32 can be undertaken in the same way; for this purpose, however, use may likewise also be made of a conventional filter method—that is to say, without estimation of signal components for a respective prediction period of the individual signal blocks. The decision about this is made, in particular, in a manner depending on the total latency to be tolerated of the binaural hearing system 1 and depending on the delay that is being attempted by the binaural transmission process.

Even though the invention has been illustrated and described in greater detail by means of the preferred exemplary embodiment, the invention is not restricted by this exemplary embodiment. Other variations can be derived therefrom by a person skilled in the art without departing from the scope of protection of the invention.

The following is a summary list of reference numerals and the corresponding structure used in the above description of the invention:

1 binaural hearing system
2 first hearing aid
4 second hearing aid
6 microphone
8 first input transducer
9 acoustic signal
10 first audio signal
12 microphone
14 second input transducer
16 second audio signal
18 local signal preprocessing
20 local signal preprocessing
22 binaural transmission process
24 signal-processing unit
26 first filter bank
28 filtered first audio signal
30 frequency-band signal processing (SPU)
32 second filter bank
34 filtered second audio signal
36 output signal (OUT)
38 loudspeaker
40 output transducer
42 output acoustic signal
50*a-f* signal block
52*a, b* real signal components
54*c* transmission amplitude
56*c* filter function
58*c* partial interval
60*c* prediction period
62*c* point of inflection
64*c* maximum
66*b* estimated signal components
68*c* predicted signal block
t, t' time axis

The invention claimed is:

1. A method for reducing the latency period of a filter bank for filtering an audio signal, the method comprising:

receiving an audio signal and forming from the audio signal a multiplicity of signal blocks in a time domain; and for at least a plurality of the signal blocks in each instance:

providing a predetermined filter function;

providing at least one partial interval of the respective signal block as a prediction period;

estimating signal components of the respective signal block in the at least one partial interval for the prediction period, and generating a predicted signal block from the signal components estimated for the prediction period and from the signal components of the respective signal block outside the prediction period; and transforming the predicted signal block, filtered with the predetermined filter function, into a frequency domain, to thereby form a transformed signal block; and outputting signal components of the transformed signal block for further processing;

wherein in each instance a transmission amplitude of the predetermined filter function is smaller, on average, within the prediction period than outside the prediction period.

2. The method according to claim 1, wherein each two temporally consecutive signal blocks partially overlap.

3. The method according to claim 1, which comprises separately outputting signal components of the transformed signal block according to various frequency bands in each instance for further processing.

4. The method according to claim 1, wherein:

the transmission amplitude of the predetermined filter function is constituted in each instance by a logarithmically concave function; and the prediction period omits a maximum of the transmission amplitude of the predetermined filter function.

5. The method according to claim 4, wherein in each instance the prediction period includes only convex regions of the transmission amplitude of the predetermined filter function.

6. The method according to claim 1, which comprises estimating a blank signal in each instance as signal components for the prediction period of at least one signal block.

7. A method for low-latency operation of a hearing system, the method comprising:

generating a first audio signal from an acoustic signal by a first input transducer;

immediately transmitting the first audio signal to a signal-processing unit and immediately filtering the first audio signal in the signal-processing unit by way of a first filter bank by performing the method according to claim 1;

subjecting the signal components of the filtered first audio signal to further processing in the signal-processing unit and using the further processed signal components for generating an output signal; and immediately generating an output acoustic signal from the output signal by an output transducer.

8. The method according to claim 7, which comprises:

generating a second audio signal from the acoustic signal by a second input transducer spatially separated from the first input transducer;

immediately transmitting the second audio signal to the signal-processing unit and filtering by way of a second filter bank to form a filtered second audio signal; and subjecting signal components of the filtered second audio signal to further processing in the signal-processing unit and using the further processed second audio signal for generating the output signal.

9. A hearing aid, comprising:

an input transducer for generating an audio signal;

an output transducer for generating an output acoustic signal; and a signal-processing unit connected between said input transducer and said output transducer, said signal-processing unit including a first filter bank;

said hearing aid configured to carry out a method for low-latency operation of a hearing system, the method including: generating a first audio signal from an acoustic signal by a first input transducer, immediately transmitting the first audio signal to a signal-processing unit and immediately filtering the first audio signal in the signal-processing unit by way of a first filter bank by performing a method for reducing the latency period of a filter bank for filtering an audio signal, the method for reducing the latency period of the filter bank for filtering the audio signal including:

receiving an audio signal and forming from the audio signal a multiplicity of signal blocks in a time domain, and for at least a plurality of the signal blocks in each instance:

providing a predetermined filter function, providing at least one partial interval of the respective signal block as a prediction period, estimating signal components of the respective signal block in the at least one partial interval for the prediction period, and generating a predicted signal block from the signal components estimated for the prediction period and from the signal components of the respective signal block outside the prediction period, transforming the predicted signal block, filtered with the predetermined filter function, into a frequency domain, to thereby form a transformed signal block, and outputting signal components of the transformed signal block for further processing, wherein in each instance a transmission amplitude of the predetermined filter function is smaller, on average, within the prediction period than outside the prediction period;

subjecting the signal components of the filtered first audio signal to further processing in the signal-processing unit and using the further processed signal components for generating an output signal; and immediately generating an output acoustic signal from the output signal by an output transducer.

10. The hearing aid according to claim 9 configured as a binaural hearing system with two hearing aids each having an input transducer and an output transducer and configured to carry out the method according to claim 8.

11. A method for reducing the latency period of a filter bank for filtering an audio signal, the method comprising:

receiving an audio signal and forming from the audio signal a multiplicity of signal blocks in a time domain; and for at least a plurality of the signal blocks in each instance:

providing a predetermined filter function;

providing at least one partial interval of the respective signal block as a prediction period;

estimating signal components of the respective signal block in the at least one partial interval for the prediction period, and generating a predicted signal block from the signal components estimated for the prediction period and from the signal components of the respective signal block outside the prediction period; and transforming the predicted signal block, filtered with the predetermined filter function, into a frequency domain, to thereby form a transformed signal block; and outputting signal components of the transformed signal block for further processing.

* * * * *